US009785082B2

(12) United States Patent
Morishige et al.

(10) Patent No.: US 9,785,082 B2
(45) Date of Patent: Oct. 10, 2017

(54) CHARGING MEMBER, PROCESS CARTRIDGE, AND IMAGE FORMING APPARATUS

(71) Applicant: FUJI XEROX CO., LTD., Tokyo (JP)

(72) Inventors: Takuya Morishige, Kanagawa (JP); Takuro Hoshio, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/227,047

(22) Filed: Aug. 3, 2016

(65) Prior Publication Data

US 2017/0261879 A1 Sep. 14, 2017

(30) Foreign Application Priority Data

Mar. 8, 2016 (JP) ..... 2016-044614

(51) Int. Cl.
*G03G 15/02* (2006.01)

(52) U.S. Cl.
CPC ..... *G03G 15/0233* (2013.01)

(58) Field of Classification Search
CPC ..... G03G 13/025; G03G 15/0233; G03G 15/0208; G03G 15/0216; G03G 15/162; G03G 15/1685; G03G 15/0806; G03G 15/0818; G03G 2215/021; G03G 2215/1614; G03G 2215/1619; G03G 2215/1623; G03G 2215/1628; G03G 2215/0861
USPC ..... 399/174, 176, 265, 279, 286, 313; 430/35; 492/17, 18, 53, 54, 55, 56, 58, 492/59
See application file for complete search history.

(56) References Cited

U.S. PATENT DOCUMENTS 5,659,854 A * 8/1997 Masuda ..... C08G 18/69 361/221
5,666,626 A * 9/1997 Takizawa ..... G03G 15/0818 399/286
7,561,828 B2 * 7/2009 Nukada ..... G03G 15/5008 399/159
2006/0014092 A1 * 1/2006 Nukada ..... G03G 5/144 430/60
2008/0107451 A1 * 5/2008 Nukada ..... G03G 15/0233 399/176
2016/0378011 A1 * 12/2016 Takeno ..... G03G 21/18 428/411.1

FOREIGN PATENT DOCUMENTS

JP 2009-175427 A 8/2009
JP 2010-102016 A 5/2010
JP 2010-197936 A 9/2010

* cited by examiner

*Primary Examiner* — Robert Beatty
(74) *Attorney, Agent, or Firm* — Sughrue Mion, PLLC

(57) ABSTRACT

A charging member includes a conductive substrate and a surface layer disposed on the conductive substrate. The surface layer includes an inorganic conductant agent including a metal and an organic conductant agent that includes a coordinating atom capable of coordinating to the metal and that has a molecular weight of 400 or less.

14 Claims, 4 Drawing Sheets

CHARGING MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-044614 filed Mar. 8, 2016.

BACKGROUND (i) Technical Field

The present invention relates to a charging member, a process cartridge, and an image forming apparatus.

(ii) Related Art

In electrophotographic image forming apparatuses, the surface of an image carrier (e.g., a photoreceptor) is charged with a charging device or the like and subsequently irradiated with a laser beam or the like modulated in accordance with an image signal in order to form an electrostatic latent image, which is developed with a charged toner to form a toner image. The toner image is transferred to a recording medium directly or via an intermediate transfer body to form a desired image.

Known examples of a charging device included in such image forming apparatuses include contactless charging devices such as corotron and scorotron, which perform charging by using corona discharge generated by applying a high voltage to a common metal wire. On the other hand, instead of these contactless charging devices, contact charging devices including a charging roller have been widely used because, for example, the contact charging devices generally require a lower voltage and generate a smaller amount of ozone than the contactless charging devices.

SUMMARY

According to an aspect of the invention, there is provided a charging member including a conductive substrate and a surface layer on the conductive substrate. The surface layer includes an inorganic conductant agent including a metal and an organic conductant agent. The organic conductant agent includes a coordinating atom capable of coordinating to the metal and has a molecular weight of 400 or less.

BRIEF DESCRIPTION OF THE DRAWINGS

Exemplary embodiments of the present invention will be described in detail based on the following figures, wherein.

DETAILED DESCRIPTION

Figure 1:
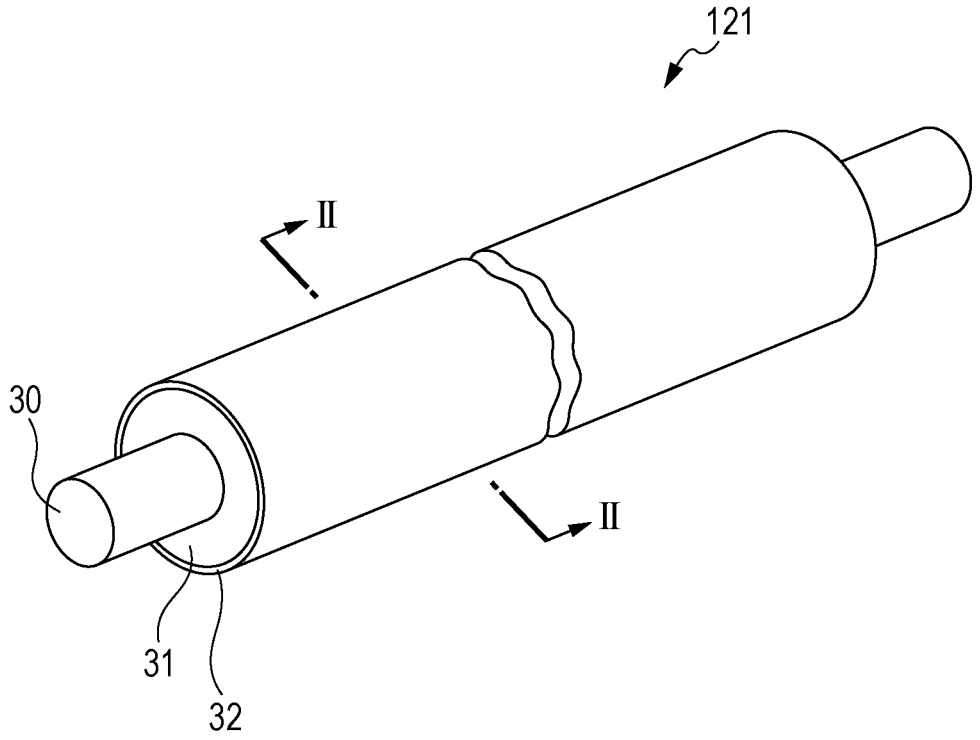
FIG. 1 is a schematic perspective view of an example of a charging member according to an exemplary embodiment.

Exemplary embodiments of the invention are described below with reference to the attached drawings.

Members having substantially the same function are denoted by the same reference numeral throughout the drawings. Duplicate description and the reference numeral of such members may be omitted.

Charging Member

A charging member according to an exemplary embodiment includes a conductive substrate and a surface layer disposed on the conductive substrate. The surface layer includes an inorganic conductant agent including a metal and an organic conductant agent that includes a coordinating atom capable of coordinating to the metal and that has a molecular weight of 400 or less. The term "organic conductant agent capable of coordinating to the metal" used herein refers to a compound that includes a coordinating atom having a lone pair and that is capable of forming a complex by binding to a metal with the coordinating atom to form a coordinate bond.

Charging members that include a conductive substrate and a surface layer disposed on the conductive substrate, the surface layer including a conductant agent, have been used as a unit that charges a body such as a photoreceptor.

However, repeatedly applying a voltage to such a charging member in order to charge the body that is to be charged may non-uniformly increase the electrical resistance of the surface of the charging member. That is, inconsistency in the electrical resistance of the surface of the charging member is likely to increase with time. This increases inconsistency in the charging property of the charging member.

Inconsistency in the charging property of the charging member is considered to be increased by the following mechanisms. Repeated use of the charging member causes the surface layer to be expanded and contracted. This causes a conductant agent included in the surface layer to migrate, which breaks conductive paths.

If a charging member having an inconsistent charging property is used for charging a body that is to be charged, the body may be charged in an inconsistent manner. In particular, in the case where such a charging member is used for, for example, charging a photoreceptor included in an image forming apparatus, the photoreceptor may be charged in an inconsistent manner and image defects such as inconsistent concentration, color spots, white spots, and streaks are likely to occur due to inconsistency in the charge on the photoreceptor.

In order to limit the migration of the conductant agent, there has been proposed a technique in which the surfaces of conductant agent particles are covered with a compound having a bulky siloxane dendrimer structure. However, this technique may degrade the conductivity of the charging member while limiting the migration of the conductant agent.

In order to address this, the charging member according to this exemplary embodiment includes a surface layer including two types of conductant agents, that is, an inorganic conductant agent including a metal and an organic conductant agent that includes a coordinating atom capable of coordinating to the metal and that has a molecular weight of 400 or less. This may reduce the likelihood of the two conductant agents, that is, the inorganic conductant agent and the organic conductant agent, migrating inside the surface layer, which reduces the breakage of the conductive paths. As a result, an increase in inconsistency in the electrical resistance of the surface of the charging member with time, that is, an increase in inconsistency in the charging property of the charging member with time, may be limited.

The reasons for this have not been clarified yet, but are considered to be the following.

In this exemplary embodiment, as described above, the inorganic conductant agent includes a metal, and the organic conductant agent includes a coordinating atom capable of coordinating to the metal. Thus, in the surface layer, the coordinating atom (e.g., an oxygen atom (=O) having a lone pair) of the organic conductant agent is considered to bind to the metal included in the inorganic conductant agent to form a coordinate bond and, as a result, a complex is formed.

In the charging member according to this exemplary embodiment, formation of the coordinate bond is considered to limit an increase in inconsistency in the charging property of the charging member. Specifically, formation of the coordinate bond increases the binding force between the inorganic conductant agent and the organic conductant agent included in the surface layer. This reduces the likelihood of the inorganic conductant agent and the organic conductant agent migrating together even in the case where the surface layer is expanded and contracted due to repeated use of the charging member, which reduces breakage of conductive paths.

Furthermore, in this exemplary embodiment, the molecular weight of the organic conductant agent is limited to be 400 or less in consideration of the bulkiness of the molecular structure of the organic conductant agent. Thus, the organic conductant agent has a molecular structure capable of coordinating to the metal included in the inorganic conductant agent. In other words, this increases the likelihood of the coordinating atom included in the organic conductant agent and the metal included in the inorganic conductant agent binding to each other to form a coordinate bond.

In addition, in this exemplary embodiment, the surface layer includes the two types of conductant agents, that is, the inorganic conductant agent and the organic conductant agent. This makes it easy to maintain the conductivity of the surface layer to be substantially uniform compared with the case where the surface layer includes only the inorganic conductant agent. In other words, this makes it easy to maintain the conductivity of the surface layer.

For the above reasons, a charging member having the above-described structure may have a charging property that is less likely to become more non-uniform with time. Limiting an increase in inconsistency in the charging property of the charging member with time may increase the service life of the charging member.

Moreover, an image forming apparatus including a charging member having the above-described structure may reduce the occurrence of image defects such as inconsistent concentration, color spots, white spots, and streaks which may be caused due to an increase in inconsistency in the charging property of the charging member.

Although inconsistency in the charging property of the charging member is especially likely to occur in a low-temperature, low-humidity environment (e.g., 10° C. and 15% RH), a charging member having the above-described structure has a charging property that is less likely to become more non-uniform with time even in the low-temperature, low-humidity environment.

Thus, an image forming apparatus that includes a charging member having the above-described structure may reduce the occurrence of image defects such as inconsistent concentration, color spots, white spots, and streaks which may be caused due to an increase in inconsistency in the charging property of the charging member even in the case where images are formed in the low-temperature, low-humidity environment.

The charging member according to this exemplary embodiment may be used as a charging member that charges a body by coming into contact with the body. The charging member may be used as, for example, a charging member included in an image forming apparatus. Specifically, the charging member according to this exemplary embodiment may be used, for example, as a charging member that charges an image carrier such as a photoreceptor or as a transfer member that transfers a toner from an image carrier to a recording medium.

The term "conductive" used herein refers to having a volume resistivity of $1\times10^{14}$ Ωcm or less at 20° C.

Figure 2:
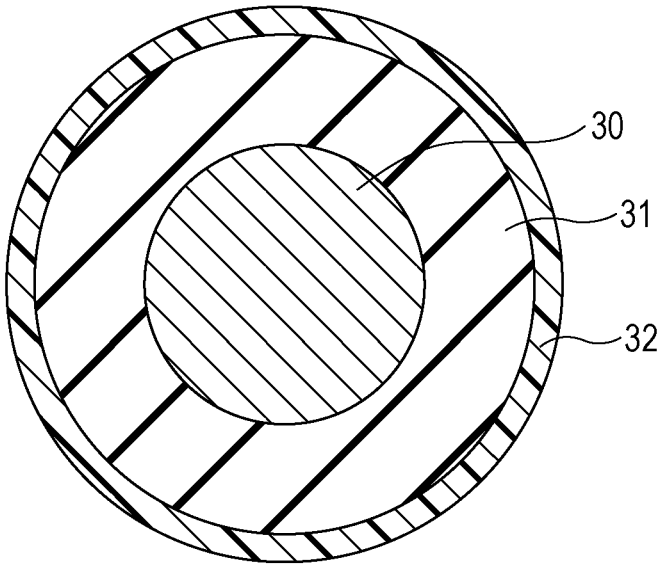
FIG. 2 is a schematic cross-sectional view of an example of a charging member according to an exemplary embodiment.

FIG. 1 is a schematic perspective view of the charging member according to this exemplary embodiment. FIG. 2 is a schematic cross-sectional view of the charging member according to this exemplary embodiment, which is taken along the line II-II of FIG. 1.

As illustrated in FIGS. 1 and 2, a charging member 121 according to this exemplary embodiment is a roller-like member including, for example, a hollow or solid cylindrical, conductive substrate 30 (i.e., shaft), an elastic layer 31 disposed on the outer peripheral surface of the conductive substrate 30, and a surface layer 32 disposed on the outer peripheral surface of the elastic layer 31.

The structure of the charging member 121 according to this exemplary embodiment is not limited to the above-described one. For example, the elastic layer 31 may be omitted. An intermediate layer (e.g., an adhesive layer) may optionally be interposed between the elastic layer 31 and the conductive substrate 30. A resistance adjustment layer or a transfer prevention layer may optionally be interposed between the elastic layer 31 and the surface layer 32. The charging member 121 according to this exemplary embodiment may be constituted by only the conductive substrate 30 and the surface layer 32.

Although a charging member having a roller-like shape is described as an example in this exemplary embodiment, the shape of the charging member 121 is not limited to a roller-like shape. The charging member 121 may have any shape such as a roller-like shape, a brush-like shape, a belt (tube)-like shape, or a blade-like shape. Among these shapes, in particular, the charging member according to this exemplary embodiment may have a roller-like shape. In other words, the charging member may be a charging roller.

The components of the charging member 121 according to this exemplary embodiment are described in detail below.

Conductive Substrate

The conductive substrate 30 is composed of a conductive material. Examples of the conductive material include metals and alloys such as aluminium, a copper alloy, and stainless steel; iron plated with chromium, nickel, or the like; and conductive resins.

The conductive substrate 30 serves as an electrode and a substrate of the charging member 121 (e.g., a charging roller). The conductive substrate 30 is composed of a metal such as iron (e.g., free-cutting steel), copper, brass, stainless steel, aluminium, or nickel.

The conductive substrate 30 is a conductive, rod-like member. The conductive, rod-like member may be prepared by plating the outer peripheral surface of a member composed of a resin, ceramic, or the like or by dispersing a conductant agent in a member composed of a resin, ceramic, or the like.

The conductive substrate 30 may be a hollow member (i.e., tubular member) or a nonhollow member.

Elastic Layer

The elastic layer 31 may optionally be disposed on the outer peripheral surface of the conductive substrate 30.

The elastic layer 31 includes, for example, an elastic material, a conductant agent, and, as needed, other additives.

Examples of the elastic material include an isoprene rubber, a chloroprene rubber, an epichlorohydrin rubber, a butyl rubber, polyurethane, a silicone rubber, a fluorine rubber, a styrene-butadiene rubber, a butadiene rubber, a nitrile rubber, an ethylene propylene rubber, an epichlorohydrin-ethylene oxide copolymer rubber, an epichlorohydrin-ethylene oxide-allyl glycidyl ether copolymer rubber, an ethylene-propylene-diene terpolymer rubber (EPDM), an acrylonitrile-butadiene copolymer rubber (NBR), natural rubbers, and rubber blends thereof. In particular, polyurethane, a silicone rubber, an EPDM, an epichlorohydrin-ethylene oxide copolymer rubber, an epichlorohydrin-ethylene oxide-allyl glycidyl ether copolymer rubber, an NBR, and rubber blends thereof may be used. These elastic materials may be, but are not necessarily, foamed.

The elastic layer 31 may include a conductant agent in order to enhance the conductivity of the elastic layer 31. Examples of the conductant agent include an electron conductant agent and an ion conductant agent. Examples of the electron conductant agent include a powder of carbon black such as Ketjen black or acetylene black; powders of pyrolytic carbon and graphite; powders of various conductive metals and alloys such as aluminium, copper, nickel, and stainless steel; powders of various conductive metal oxides such as tin oxide, indium oxide, titanium oxide, a tin oxide-antimony oxide solid solution, and a tin oxide-indium oxide solid solution; and a powder of an insulating material the surfaces of particles of which have been treated to have conductivity. Examples of the ion conductant agent include perchlorates and chlorates of tetraethylammonium, lauryltrimethylammonium, and the like; and perchlorates and chlorates of alkali metals and alkaline-earth metals such as lithium and magnesium.

These conductant agents may be used alone or in combination of two or more.

Specific examples of the carbon black include "SPECIAL BLACK 350", "SPECIAL BLACK 100", "SPECIAL BLACK 250", "SPECIAL BLACK 5", "SPECIAL BLACK 4", "SPECIAL BLACK 4A", "SPECIAL BLACK 550", "SPECIAL BLACK 6", "COLOR BLACK FW200", "COLOR BLACK FW2", and "COLOR BLACK FW2V" produced by Orion Engineered Carbons; and "MONARCH1000", "MONARCH1300", "MONARCH1400", "MOGUL-L", and "REGAL400R" produced by Cabot Corporation.

These conductant agents may have an average particle diameter of 1 nm or more and 200 nm or less. The average particle diameter of a conductant agent is measured by observing a sample taken from the elastic layer 31 with an electron microscope, measuring the diameters (maximum diameters) of 100 particles of the conductant agent, and taking the average thereof. The measurement of average particle diameter may be carried out using, for example, "Zetasizer Nano ZS" produced by Sysmex Corporation.

The content of the conductant agent in the elastic layer 31 is not limited. In the case where the above electron conductant agents are used as a conductant agent, the content of the conductant agent in the elastic layer 31 is desirably 1 part by weight or more and 30 parts by weight or less and is more desirably 15 parts by weight or more and 25 parts by weight or less relative to 100 parts by weight of the elastic material. In the case where the above ion conductant agents are used as a conductant agent, the content of the conductant agent in the elastic layer 31 is desirably 0.1 part by weight or more and 5.0 parts by weight or less and is more desirably 0.5 parts by weight or more and 3.0 parts by weight or less relative to 100 parts by weight of the elastic material.

Examples of the other additives that may be added to the elastic layer 31 include a softener, a plasticizer, a curing agent, a vulcanizing agent, a vulcanization accelerator, an antioxidant, a surfactant, a coupling agent, a filler (e.g., silica or calcium carbonate), and a blowing agent, which are commonly added to an elastic layer.

A method for and an order of mixing together the conductant agent, the elastic material, and the other components (i.e., components such as a vulcanizing agent and a blowing agent added as needed), which constitute the elastic layer 31, in order to form the elastic layer 31 are not limited. In general, for example, all the above components are mixed together using a tumbler, a V-blender, or the like, and the resulting mixture is melt-mixed and extruded into shape with an extruder. In another case, the mixture is formed into shape with a press-forming machine, and the shaped material is subsequently ground.

The thickness of the elastic layer 31 is desirably 1 mm or more and 10 mm or less and is more desirably 2 mm or more and 5 mm or less.

The volume resistivity of the elastic layer 31 may be $10^3$ Ωcm or more and $10^{14}$ Ωcm or less.

Surface Layer

The surface layer 32 includes, for example, a resin (i.e., polymer), an inorganic conductant agent including a metal (hereinafter, referred to as "specific inorganic conductant agent"), and an organic conductant agent that includes a coordinating atom capable of coordinating to the metal and that has a molecular weight of 400 or less (hereinafter, referred to as "specific organic conductant agent"). The surface layer 32 may optionally include a filler, other additives, and the like.

Specific Inorganic Conductant Agent

The specific inorganic conductant agent includes a metal. In the surface layer 32, the metal is capable of binding to the coordinating atom included in the specific organic conductant agent to form a coordinate bond.

Examples of the specific inorganic conductant agent include particles of a metal, a metal oxide, and a metal chloride.

Examples of the metal include Zn, Sn, Ti, Al, Cu, Ni, Pd, Cr, Mn, Fe, Co, In, Mg, Ca, Bi, Zr, and alloys of these elements.

Examples of the metal oxide include oxides including the above elements, such as ZnO, $SnO_2$, and $TiO_2$. Examples of the metal chloride include chlorides including the above elements, such as $SnCl_2$, $CuCl_2$, and $NiCl_2$.

In particular, metal oxide particles may be used as a specific inorganic conductant agent in order to limit an increase in inconsistency in the charging property of the charging member 121 with time and to achieve the targeted electrical resistance. The above specific inorganic conductant agents may be used alone or in combination of two or more.

The average particle diameter of the specific inorganic conductant agent is preferably 25 nm or more and 200 nm or less and is more preferably 50 nm or more and 100 nm or less in order to increase the likelihood of the metal included in the specific inorganic conductant agent and the coordinating atom included in the specific organic conductant agent binding to each other to form a coordinate bond.

The average particle diameter of the specific inorganic conductant agent is determined by observing a sample taken from the surface layer 32 with an electron microscope, measuring the diameters (maximum diameters) of 100 particles of the specific inorganic conductant agent, and taking the average thereof. For determining the average particle diameter of the specific inorganic conductant agent, for example, "Zetasizer Nano ZS" produced by Sysmex Corporation may be used.

The content of the specific inorganic conductant agent in the surface layer 32 is preferably such that the amount of specific inorganic conductant agent is 5 parts by weight or more and 50 parts by weight or less relative to 100 parts by weight of a resin included in the surface layer 32 and is more preferably such that the amount of specific inorganic conductant agent is 12 parts by weight or more and 25 parts by weight or less relative to 100 parts by weight of a resin included in the surface layer 32 in order to increase the likelihood of the metal included in the specific inorganic conductant agent and the coordinating atom included in the specific organic conductant agent binding to each other to form a coordinate bond and to achieve the targeted electrical resistance.

Specific Organic Conductant Agent

The specific organic conductant agent includes a coordinating atom capable of coordinating to the metal.

The coordinating atom having a lone pair of electrons is, for example, at least one selected from an oxygen atom, a nitrogen atom, a sulfur atom, a phosphorus atom, and the like.

Since the specific organic conductant agent includes the coordinating atom capable of coordinating to the metal, in the surface layer 32, the coordinating atom and the metal included in the specific inorganic conductant agent are considered to bind to each other to form a coordinate bond.

The specific organic conductant agent may include only one coordinating atom or two or more coordinating atoms. The specific organic conductant agent may be a monodentate ligand or a polydentate ligand.

The specific organic conductant agent has a molecular weight of 400 or less. This reduces the likelihood of the specific organic conductant agent having a bulky molecular structure and increases the likelihood of the coordinating atom included in the specific organic conductant agent and the metal included in the specific inorganic conductant agent binding to each other to form a coordinate bond.

Examples of the specific organic conductant agent include particles of anthraquinone, benzoquinone, coumarin, anthocyanin, flavone, xanthene, and benzoxazine; and particles of derivatives of these compounds. Among the above specific organic conductant agents, in particular, anthraquinone particles and anthraquinone derivative particles may be used in order to limit an increase in inconsistency in the charging property of the charging member 121 with time. The above specific organic conductant agents may be used alone or in combination of two or more.

The anthraquinone derivative particles may be, for example, particles of the compound represented by General Formula (1) below. The term "anthraquinone derivative" used herein refers to a compound including an anthraquinone skeleton.

(1)

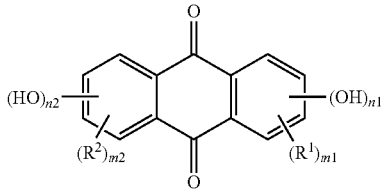

In General Formula (1), n1 and n2 each independently represent an integer of from 0 to 3; at least one of n1 and n2 each independently represent an integer of from 1 to 3, that is, n1 and n2 do not become 0 simultaneously; m1 and m2 each independently represent an integer of 0 or 1; and $R^1$ and $R^2$ each independently represent an alkyl group having from 1 to 10 carbon atoms, an alkoxy group having from 1 to 10 carbon atoms, or a carboxy group.

The alkyl groups having from 1 to 10 carbon atoms represented by $R^1$ and $R^2$ in General Formula (1) may be linear or branched. Examples of the alkyl groups include a methyl group, an ethyl group, a propyl group, and an isopropyl group. The alkyl groups having from 1 to 10 carbon atoms are preferably alkyl groups having from 1 to 8 carbon atoms and are more preferably alkyl groups having from 1 to 6 carbon atoms.

The alkoxy (alkoxyl) groups having from 1 to 10 carbon atoms represented by $R^1$ and $R^2$ in General Formula (1) may be linear or branched. Examples of the alkoxy groups include a methoxy group, an ethoxy group, a propoxy group, and an isopropoxy group. The alkoxy groups having from 1 to 10 carbon atoms are preferably alkoxyl groups having from 1 to 8 carbon atoms and are more preferably alkoxyl groups having from 1 to 6 carbon atoms.

Specific examples of the anthraquinone derivative include, but are not limited to, the following compounds. Note that Compound 1-1 is anthraquinone.

Among the compounds below, Compounds 1-1 to 1-12 are preferably used and Compound 1-1 (anthraquinone), Compound 1-3 (alizarin), Compound 1-4 (quinizarin), and Compound 1-12 (quinalizarin) are more preferably used in order to limit an increase in inconsistency in the charging property of the charging member with time. In the structural formulae below, "—OMe" represents a methoxy group, "—OEt" represents an ethoxy group, and "—OBu" represents a butoxy group.

1-1

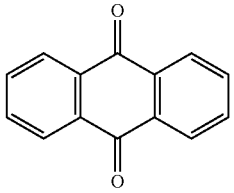

1-2

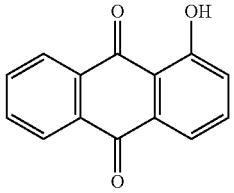

-continued 1-3

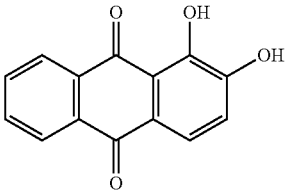

1-4

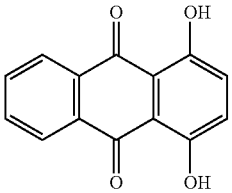

1-5

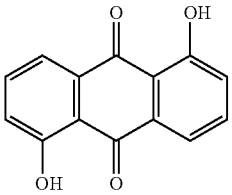

1-6

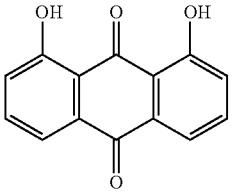

1-7

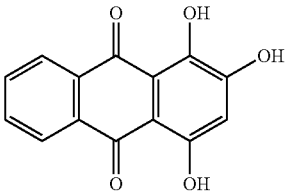

1-8

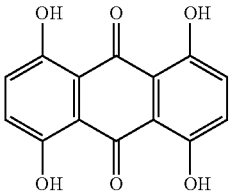

1-9

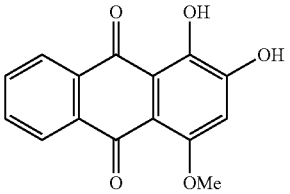

1-10

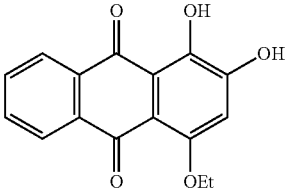

-continued 1-11

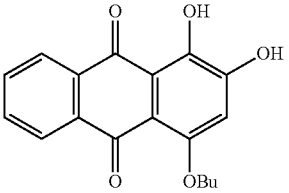

1-12

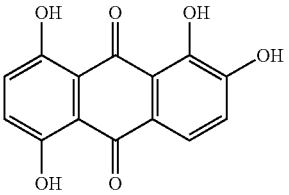

1-13

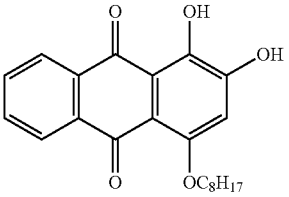

1-14

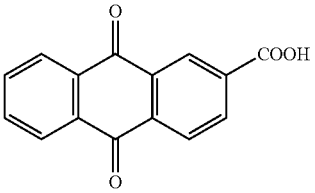

The average particle diameter of the specific organic conductant agent may be 50 nm or less in order to increase the likelihood of the metal included in the specific inorganic conductant agent and the coordinating atom included in the specific organic conductant agent binding to each other to form a coordinate bond.

The average particle diameter of the specific organic conductant agent is determined as in the measurement of the average particle diameter of the specific inorganic conductant agent.

The content of the specific organic conductant agent in the surface layer 32 may be such that the amount of specific organic conductant agent is 0.5 parts by weight or more and 2 parts by weight or less relative to 100 parts by weight of a resin included in the surface layer 32 in order to increase the likelihood of the metal included in the specific inorganic conductant agent and the coordinating atom included in the specific organic conductant agent binding to each other to form a coordinate bond and to achieve the targeted electrical resistance.

The molar ratio between the specific inorganic conductant agent to the specific organic conductant agent included in the surface layer 32 (specific inorganic conductant agent:specific organic conductant agent) may be 20:1 to 100:1.

Limiting the molar ratio of the specific inorganic conductant agent to the specific organic conductant agent to be within the above range increases the likelihood of the metal included in the specific inorganic conductant agent and the coordinating atom (e.g., an oxygen atom (=O) having a lone pair) included in the specific organic conductant agent binding to each other in the surface layer to form a coordinate bond. This reduces the likelihood of the inorganic conductant agent and the organic conductant agent migrating together even in the case where the surface layer is expanded and contracted due to repeated use of the charging member 121, which reduces breakage of conductive paths. As a result, an increase in inconsistency in the charging property of the charging member with time may be limited.

Other Conductant Agents

Conductant agents other than the specific inorganic conductant agent or the specific organic conductant agent which do not impair the effect of this exemplary embodiment may optionally be added to the surface layer 32 in combination with the above specific inorganic conductant agent and the above specific organic conductant agent.

Examples of the other conductant agents that may be added to the surface layer 32 are the same as the above-described examples of conductant agents that may be added to the elastic layer 31 (excluding the above specific inorganic conductants agent and the above specific organic conductant agents).

Filler

The surface layer 32 may optionally include a filler. Adding a filler to the surface layer 32 increases ease of controlling the electric characteristics and surface roughness of the surface layer 32 to fall within appropriate ranges and, as a result, further limits an increase in inconsistency in the charging property of the charging member 121 with time. In addition, the likelihood of the surface of the charging member being contaminated by substances (e.g., toner particles and external additive particles) deposited on the surface of the charging member may be reduced.

Both conductive particles (excluding particles of the above specific inorganic conductant agents and particles of the above specific organic conductant agents) and nonconductive particles may be used as a filler. In particular, nonconductive particles may be used as a filler.

Examples of the nonconductive particles include resin particles such as polyamide resin particles, polyimide resin particles, methacrylic resin particles, polystyrene resin particles, fluorine resin particles, and silicone resin particles; inorganic particles such as clay particles, kaolin particles, talc particles, silica particles, and alumina particles; and ceramic particles. The above fillers may be used alone or in combination of two or more.

The resin constituting the filler particles may be the same as the resin (i.e., polymer) described below. The term "nonconductive" used herein refers to having a volume resistivity of more than $10^{14}$ Ωcm at 20° C.

The amount of filler is preferably, but not limited to, 1 part by weight or more and 100 parts by weight or less and more preferably 5 parts by weight or more and 60 parts by weight or less relative to 100 parts by weight of a resin (i.e., polymer) included in the surface layer 32.

The surface roughness Rz of the surface layer 32 which is formed by the filler is preferably 2 μm or more and 15 μm or less and is more preferably 3 μm or more and 10 μm or less in order to limit an increase in inconsistency in the charging property of the charging member.

In this exemplary embodiment, surface roughness Rz is ten-point average surface roughness Rz specified in JIS B0601 (1994). For measuring surface roughness Rz, measurement is made at three points in an object to be measured (e.g., when the object to be measured has a roll-like shape, at the points 20 mm from the respective ends of the object and the center of the object in the axis direction) with a surface-roughness measuring machine "SURFCOM 1400" produced by Tokyo Seimitsu Co., under the following conditions: cut-off: 0.8 mm, measurement length: 4.0 mm, traverse speed: 0.3 mm/sec, and the average thereof is taken.

Resin

The surface layer 32 may optionally include a resin (i.e., polymer).

Examples of the resin (i.e., polymer) that may be included in the surface layer 32 include, but are not limited to, polyamide, polyurethane, polyvinylidene fluoride, a tetrafluoroethylene copolymer, polyester, polyimide, a silicone resin, an acrylic resin, polyvinyl butyral, an ethylene-tetrafluoroethylene copolymer, a melamine resin, a fluorine rubber, an epoxy resin, polycarbonate, polyvinyl alcohol, cellulose, polyvinylidene chloride, polyvinyl chloride, polyethylene, an ethylene-vinyl acetate copolymer, and a nylon copolymer.

The above resins may be used alone, in combination of two or more, or in the form of a copolymer. When crosslinkable resins are used, they may be used in the form of a crosslinked product. The number-average molecular weight of the resin (i.e., polymer) is preferably 1,000 or more and 100,000 or less and is more preferably 10,000 or more and 50,000 or less.

Examples of other additives that may be added to the surface layer 32 include the following materials commonly included in a surface layer: a curing agent, a vulcanizing agent, a vulcanization accelerator, an antioxidant, a dispersing agent, a surfactant, and a coupling agent.

The surface layer 32 is formed by, for example, dispersing the resin, the specific inorganic conductant agent, and the specific organic conductant agent in a solvent in order to prepare a coating liquid; applying the coating liquid onto the surface of the conductive substrate 30 or the outer peripheral surface of the elastic layer 31; and drying the resulting coating film. For applying the coating liquid onto the surface of the conductive substrate 30 or the like, blade coating, Meyer bar coating, spray coating, dip coating, bead coating, air knife coating, curtain coating, and the like may be used.

The solvent included in the coating liquid is not limited and may be selected from the following common solvents: alcohol solvents such as methanol, ethanol, propanol, and butanol; ketone solvents such as acetone and methyl ethyl ketone; tetrahydrofuran; and ether solvents such as diethyl ether and dioxane.

The thickness of the surface layer 32 may be 0.01 μm or more and 1,000 μm or less and is desirably, for example, 2 μm or more and 25 μm or less in order to limit an increase in inconsistency in the charging property of the charging member 121 with time.

The volume resistivity of the surface layer 32 may be $10^3$ Ωcm or more and $10^{14}$ Ωcm or less in order to charge a body that is to be charged (e.g., a photoreceptor) by bringing the charging member into contact with the body.

The electrical resistance of the surface of the charging member is preferably $1\times10^3\Omega$, or more and $1\times10^{14}\Omega$ or less and is more preferably $1\times10^6\Omega$, or more and $1\times10^9\Omega$, or less when a voltage of 100 V is applied to the charging member. If the electrical resistance of the surface of the charging member is lower than $1\times10^3\Omega$, leakage of current, that is, "leaking", may be increased. If the electrical resistance of the surface of the charging member is higher than $1\times10^{14}\Omega$, accumulation of electric charge, that is, "charging up" may be increased.

The electrical resistance of the surface of the charging member is measured, for example, in the following manner.

An electrode having a roller-like shape is brought into contact with the surface of the charging member, and a voltage of 100 V is applied between the conductive substrate of the charging member and the roller-like electrode. Subsequently, the charging member is rotated, and the electrode is also rotated by the rotation of the charging member. In this state, the amounts of current and voltage between the conductive substrate of the charging member and the roller-like electrode are measured in order to determine the electrical resistance of the surface of the charging member in the circumferential direction.

Charging Device

A charging device according to an exemplary embodiment is described below.

The charging device according to this exemplary embodiment includes the charging member according to the above-described exemplary embodiment.

Figure 3:
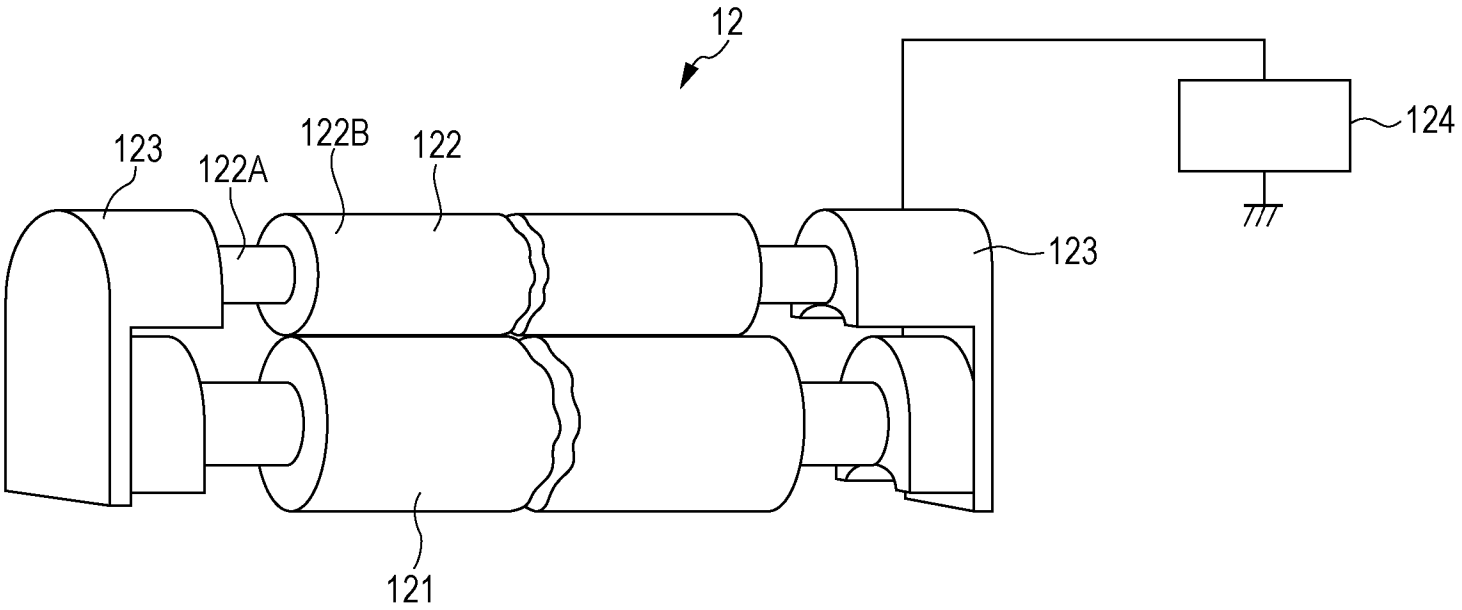
FIG. 3 is a schematic perspective view of an example of a charging device according to an exemplary embodiment.

FIG. 3 is a schematic perspective view of an example of the charging device according to this exemplary embodiment. A charging device 12 according to this exemplary embodiment includes, for example, a charging member 121 and a cleaning member 122 that are brought into contact with each other so as to be dented a certain amount as illustrated in FIG. 3. The respective ends of the conductive substrate of the charging member 121 and the respective ends of the substrate 122A of the cleaning member 122 in the axis direction are rotatably held by a pair of conductive bearings 123. One of the conductive bearings 123 is connected to a power supply 124.

The structure of the charging device according to this exemplary embodiment is not limited to the above-described one. For example, the cleaning member 122 may be omitted.

The cleaning member 122 cleans the surface of the charging member 121 and has a roller-like shape or the like. The cleaning member 122 includes, for example, a hollow or solid cylindrical substrate 122A and an elastic layer 122B disposed on the outer peripheral surface of the substrate 122A.

The substrate 122A is a conductive rod-like member composed of a metal such as iron (e.g., free-cutting steel), copper, brass, stainless steel, aluminium, or nickel. The substrate 122A may be prepared by, for example, plating the outer peripheral surface of a member composed of a resin, ceramic, or the like or dispersing a conductant agent in a member composed of a resin, ceramic, or the like. The substrate 122A may be a hollow member (i.e., tubular member) or a nonhollow member.

The elastic layer 122B may be composed of a foam having a three-dimensional porous structure including cavities and irregularities (hereinafter, referred to as "cells") in the inside and the surface thereof and may have elasticity. The elastic layer 122B includes a foamable resin material or a rubber material, such as polyurethane, polyethylene, polyamide, an olefin, melamine, polypropylene, an acrylonitrile-butadiene copolymer rubber (NBR), an ethylene-propylene-diene copolymer rubber (EPDM), a natural rubber, a styrene-butadiene rubber, chloroprene, silicone, or nitrile.

Among these foamable resin materials and rubber materials, in particular, polyurethane, which has high tearing and tensile strengths, may be used in order to enable foreign matter such as toner particles and external additive particles to be removed in an efficient manner with the cleaning member 122 being rotated by and rubbing the charging member 121, to reduce the likelihood of the surface of the charging member 121 being scratched by the cleaning member 122 rubbing against the charging member 121, and to reduce the occurrence of breakage and fracture over a long period of time.

The type of polyurethane is not limited, and examples thereof include polyurethanes produced by reacting a polyol (e.g., polyester polyol, polyether polyol, or acrylic polyol) with an isocyanate (e.g., 2,4-tolylene diisocyanate, 2,6-tolylene diisocyanate, 4,4-diphenylmethane diisocyanate, tolidine diisocyanate, or 1,6-hexamethylene diisocyanate). Polyurethanes produced by reacting the above polyol with the above isocyanate in the presence of a chain extender (e.g., 1,4-butanediol or trimethylolpropane) may also be used. In general, polyurethane is foamed using a blowing agent such as water or an azo compound (e.g., azodicarbonamide or azobisisobutyronitrile).

The number of cells in the elastic layer 122B per 25 mm is desirably 20/25 mm or more and 80/25 mm or less, is further desirably 30/25 mm or more and 80/25 mm or less, and is particularly desirably 30/25 mm or more and 50/25 mm or less.

The hardness of the elastic layer 122B is desirably 100 N or more and 500 N or less, is further desirably 100 N or more and 400 N or less, and is particularly desirably 150 N or more and 400 N or less.

The conductive bearings 123 integrally hold the charging member 121 and the cleaning member 122 such that these members are rotatable and a certain distance between the axes of these members is maintained. The conductive bearings 123 may be composed of any conductive material, and the form of the conductive bearings 123 is not limited. Conductive bearings, conductive sliding bearings, and the like may be used.

The power supply 124 applies a voltage to the conductive bearings 123 and thereby charges the charging member 121 and the cleaning member 122 to the same polarity. The power supply 124 may be any high-voltage power supply known in the related art.

In the charging device 12 according to this exemplary embodiment, the charging member 121 and the cleaning member 122 are charged to the same polarity by, for example, applying a voltage to the conductive bearing 123 by using the power supply 124. This reduces the likelihood of foreign matter (e.g., toner particles or external additives particles) that may adhere onto the surface of the image carrier accumulating at the surfaces of the cleaning member 122 and the charging member 121 and enables the foreign matter to be transferred onto the image carrier and subsequently collected by a cleaning device of the image carrier. As a result, accumulation of contaminants at the charging member 121 and the cleaning member 122 may be reduced over a long period of time, which enables the charging performance of the charging member to be maintained.

Image Forming Apparatus and Process Cartridge

An image forming apparatus according to an exemplary embodiment includes an image carrier; a charging unit (i.e., the charging device according to the above-described exemplary embodiment) including the charging member according to the above-described exemplary embodiment, the charging unit charging the surface of the image carrier by bringing the charging member into contact with the surface of the image carrier; a latent-image forming unit that forms a latent image on the charged surface of the image carrier; a developing unit that develops the latent image formed on the surface of the image carrier with a toner in order to form a toner image; and a transfer unit that transfers the toner image formed on the surface of the image carrier to a recording medium.

The process cartridge according to this exemplary embodiment is detachably attachable to the above-described image forming apparatus and includes an image carrier and a charging unit (i.e., the charging device according to the above-described exemplary embodiment) including the charging member according to the above-described exemplary embodiment, the charging unit charging the surface of the image carrier by bringing the charging member into contact with the surface of the image carrier. The process cartridge according to this exemplary embodiment may optionally include at least one unit selected from a developing unit that develops a latent image formed on the surface of the image carrier with a toner to form a toner image, a transfer unit that transfers the toner image formed on the surface of the image carrier to a recording medium, and a cleaning unit that removes a toner that remains on the surface of the image carrier from which a toner image has been transferred.

Figure 4:
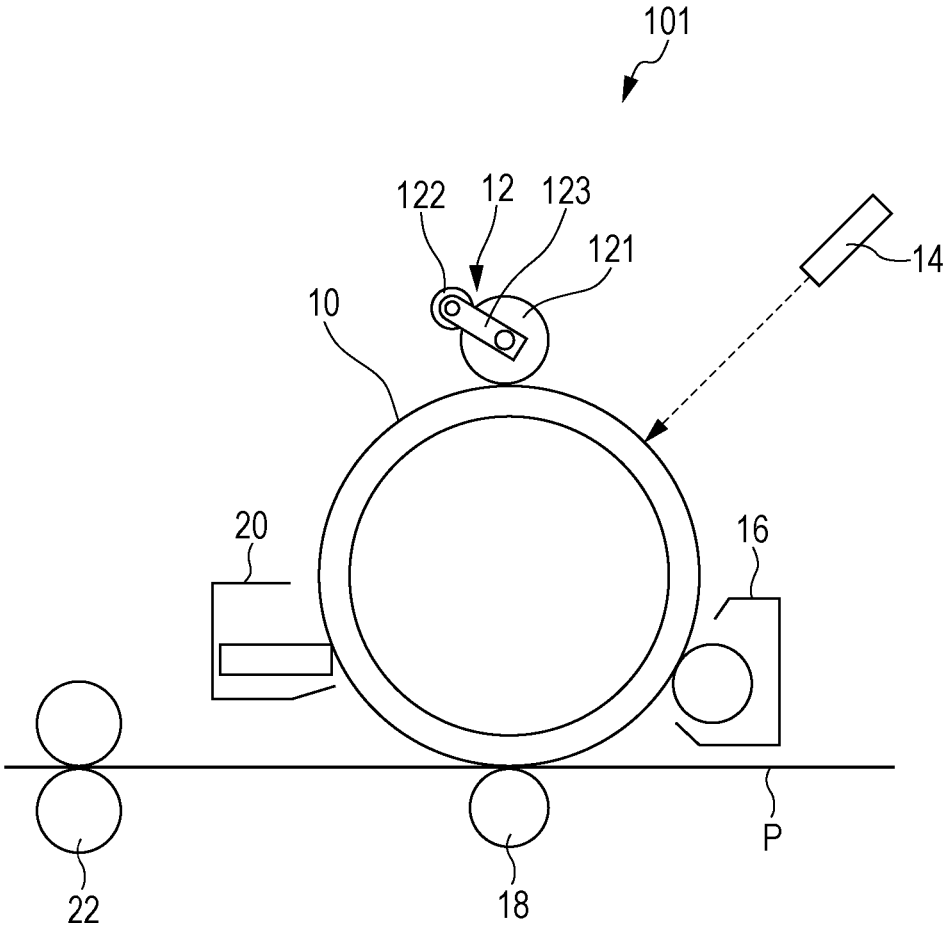
FIG. 4 is a schematic diagram illustrating an example of an image forming apparatus according to an exemplary embodiment.
Figure 5:
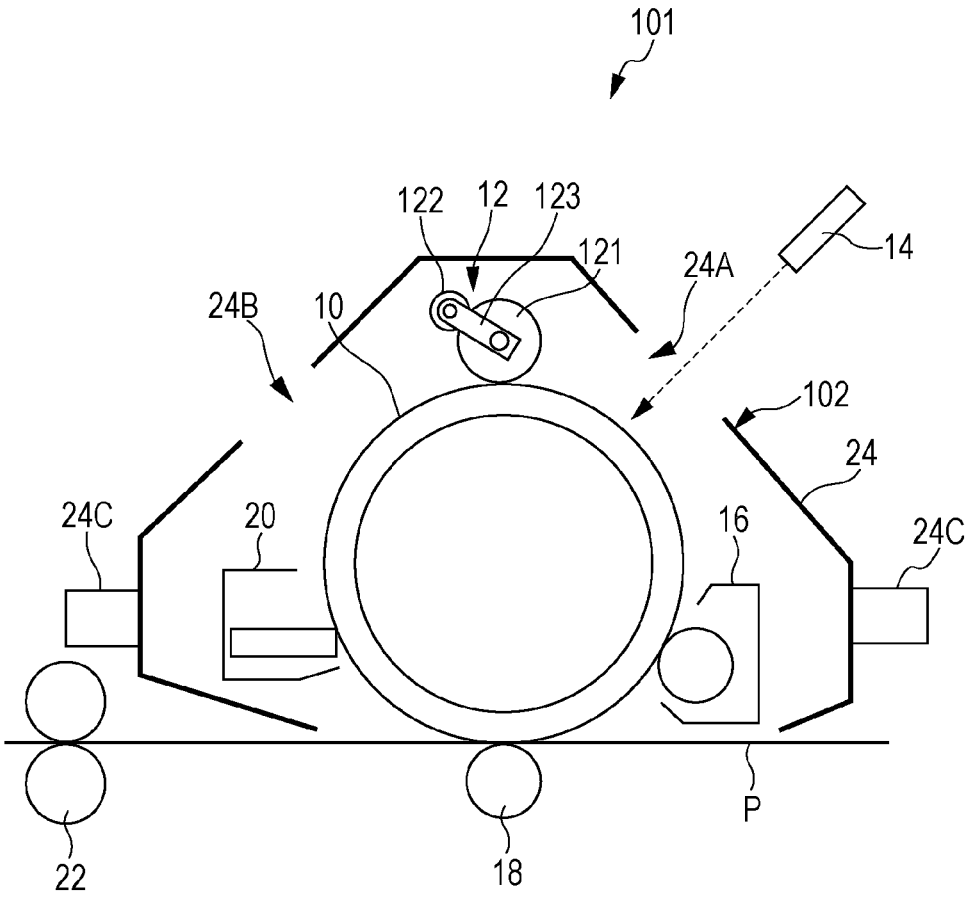
FIG. 5 is a schematic diagram illustrating an example of a process cartridge according to an exemplary embodiment.

The image forming apparatus and the process cartridge according to this exemplary embodiment are described below with reference to the attached drawings. FIG. 4 schematically illustrates an example of the image forming apparatus according to this exemplary embodiment. FIG. 5 schematically illustrates an example of the process cartridge according to this exemplary embodiment.

An image forming apparatus 101 according to this exemplary embodiment includes an image carrier 10; and a charging device 12 that charges the image carrier, an exposure device 14 that exposes the image carrier 10 that has been charged by the charging device 12 to light in order to form a latent image, a developing device 16 that develops the latent image formed by the exposure device 14 with a toner in order to form a toner image, a transfer device 18 that transfers the toner image formed by the developing device 16 to a recording medium P, and a cleaning device 20 that removes a toner that remains on the surface of the image carrier 10 from which the toner image has been transferred, which are arranged in the vicinity of the image carrier 10 as illustrated in FIG. 4. The image forming apparatus 101 further includes a fixing device 22 that fixes the toner image that has been transferred to the recording medium P by the transfer device 18.

The charging device 12 included in the image forming apparatus 101 according to this exemplary embodiment is the charging device according to the above-described exemplary embodiment that includes, for example, a charging member 121, a cleaning member 122 arranged to be brought into contact with the charging member 121, a pair of conductive bearings 123 with which the respective ends of the charging member 121 and the respective ends of the cleaning member 122 in the axis direction are rotatably held, and a power supply 124 connected to one of the conductive bearings 123 as illustrated in FIG. 3.

The components of the image forming apparatus 101 according to this exemplary embodiment which are other than the charging device 12 (i.e., the charging member 121) may be common components of an electrophotographic image forming apparatus. An example of each component is described below.

The type of the image carrier 10 is not limited, and any photoreceptor known in the related art may be used. In the case where the image carrier 10 is an organic photoreceptor, a photosensitive layer included in the organic photoreceptor may be a "separated-function" photosensitive layer that includes a charge generating layer and a charge transporting layer or an "integrated-function" photosensitive layer that serves as both charge generating layer and charge transporting layer. The image carrier 10 may include a protection layer having an electron-transportation capability and a crosslinked structure, the protection layer covering the surface layer of the image carrier 10. Photoreceptors including a siloxane resin, a phenolic resin, a melamine resin, a guanamine resin, or an acrylic resin that serves as a crosslinking component of the protection layer may also be used.

The exposure device 14 may be, for example, a laser optical system or an LED array.

The developing device 16 is, for example, a developing device that causes a toner to adhere to a latent image formed on the surface of the image carrier 10 by bringing a developer-holding member including a developer layer formed on the surface thereof into contact with or adjacent to the image carrier 10 in order to form a toner image. When the latent image is developed by the developing device 16, a developing method in which a two-component developer is used, which is known in the related art, may be employed. Examples of the developing method in which a two-component developer is used include a cascade method and a magnetic brush method.

The transfer device 18 may employ either a contactless transferring method such as a corotron or a contact transferring method, in which a toner image is transferred to a recording medium P with a conductive transfer roller being brought into contact with the image carrier 10 via the recording medium P.

The cleaning device 20 is, for example, a member that removes toner particles, paper dust particles, and dust particles that adhere on the surface of the image carrier 10 by bringing a cleaning blade or the like into direct contact with the surface of the image carrier 10. Examples of the cleaning device 20 other than a cleaning blade include a cleaning brush and a cleaning roller.

The fixing device 22 may be a heat fixing device including a heating roller. The heat fixing device includes, for example, a fixing roller and a pressure roller or a pressure belt arranged to come into pressure contact with the fixing roller at a predetermined contact pressure. The fixing roller includes a hollow cylindrical core bar; a heater lamp for heating which is disposed in the core bar; and a "release layer" that is a heat-resistant resin coating layer or a heat-resistant rubber coating layer disposed on the outer peripheral surface of the core bar. The pressure roller includes a hollow cylindrical core bar and a heat-resistant elastic body layer disposed on the outer peripheral surface of the core bar. The pressure belt includes a belt-like substrate and a heat-resistant elastic body layer disposed on the surface of the substrate. An unfixed toner image is fixed by, for example, inserting a recording medium P on which an unfixed toner image has been deposited into a clearance between the fixing roller and the pressure roller or between the fixing roller and the pressure belt and subsequently melting a binder resin included in the toner, additives, and the like by heating.

The structure of the image forming apparatus 101 according to this exemplary embodiment is not limited to the above-described one. For example, the image forming apparatus according to this exemplary embodiment may be an intermediate transfer image forming apparatus including an intermediate transfer body or a "tandem" image forming apparatus including plural image forming units arranged in parallel which form toner images in different colors.

As illustrated in FIG. 5, the process cartridge according to this exemplary embodiment is a process cartridge 102 that integrally holds the image carrier 10, the charging device 12 that charges the surface of the image carrier 10 by bringing the charging member 121 into contact with the surface of the image carrier 10, the developing device 16 that develops a latent image formed by the exposure device 14 with a toner in order to form a toner image, and the cleaning device 20 that removes a toner that remains on the surface of the image carrier 10 from which the toner image has been transferred, which are included in the above-described image forming apparatus illustrated in FIG. 4, by using a housing 24 including an opening 24A through which the image carrier is exposed to light, an opening 24B through which the image carrier is exposed to light for eliminating statistic, and an attachment rail 24C. The process cartridge 102 is detachably attached to the above-described image forming apparatus 101 illustrated in FIG. 4.

EXAMPLES

The above-described exemplary embodiments are described further in detail with reference to Examples below. However, the above-described exemplary embodiments are not limited by Examples below. In Examples, "parts" always refers to "parts by weight" unless otherwise specified.

Preparation of Photoreceptor

Formation of Undercoat Layer

With 500 parts of tetrahydrofuran, 100 parts of zinc oxide particles produced by TAYCA CORPORATION (average diameter: 70 nm, specific surface area: 15 $m^2/g$) are mixed while being stirred. To the resulting mixture, 1.25 parts of a silane coupling agent "KBM603" produced by Shin-Etsu Chemical Co., Ltd. is added. The resulting mixture is stirred for 2 hours. The mixture is subjected to distillation under reduced pressure in order to remove tetrahydrofuran and subsequently heated at 120° C. for 3 hours in order to perform burn-in. Thus, zinc oxide particles surface-treated with a silane coupling agent are prepared.

Sixty parts of the surface-treated zinc oxide particles, 0.6 parts of alizarin, 13.5 parts of a curing agent that is blocked isocyanate "Sumidur 3175" produced by Sumitomo Bayer Urethane Co., Ltd., 15 parts of a butyral resin "S-LEC BM-1" produced by SEKISUI CHEMICAL CO., LTD., and 85 parts of methyl ethyl ketone are mixed together. The resulting liquid mixture is mixed with 25 parts of methyl ethyl ketone. The resulting mixture is dispersed using a sand mill with glass beads having a diameter of 1 mm for 2 hours. To the resulting dispersion, 0.005 parts of dioctyltin dilaurate that serves as a catalyst and 4.0 parts of silicone resin particles "Tospearl 145" produced by Momentive Performance Materials Inc. are added. Thus, an undercoat-layer forming liquid is prepared.

This coating liquid is applied onto the surface of an aluminium substrate by dip coating. The resulting aluminium substrate is dried at 170° C. for 40 minutes in order to cause the deposited coating liquid to be cured. Thus, an undercoat layer having a thickness of 25 μm is formed on the aluminium substrate.

Formation of Charge Generating Layer

A photosensitive layer having a multilayer structure constituted by a charge generating layer and a charge transporting layer is formed on the undercoat layer in the following manner.

Hydroxygallium phthalocyanine (15 parts, having diffraction peaks at Bragg angles (2θ±0.2°) of at least 7.3°, 16.0°, 24.9°, and 28.0° in the X-ray diffraction spectrum with Cukα radiation) that serves as a charge generating material, 10 parts of a vinyl chloride-vinyl acetate copolymer "VMCH" produced by NUC Corporation which serves as a binder resin, and 200 parts of n-butyl acetate are mixed together, and the resulting mixture is dispersed using a sand mill with glass beads having a diameter of 1 mm for 4 hours. To the resulting dispersion, 175 parts of n-butyl acetate and 180 parts of methyl ethyl ketone are added. The resulting mixture is stirred to form a charge-generating-layer forming liquid.

The charge-generating-layer forming liquid is applied onto the surface of the undercoat layer by dip coating. The deposited coating liquid is dried at normal temperature (22° C.) to form a charge generating layer having a thickness of 0.2 μm.

Formation of Charge Transporting Layer

One part of tetrafluoroethylene resin particles, 0.02 parts of a fluorine-containing graft polymer, 5 parts of tetrahydrofuran, and 2 parts of toluene are mixed together to a sufficient degree while being stirred in order to prepare a suspension of tetrafluoroethylene resin particles.

In 10 parts of toluene, 4 parts of N,N'-diphenyl-N,N'-bis(3-methylphenyl)-[1,1']biphenyl-4,4'-diamine that serves as a charge transporting material, 6 parts of a bisphenol-Z-type polycarbonate resin (viscosity-average molecular weight: 40,000), and 23 parts of tetrahydrofuran are dissolved. The resulting solution is mixed with the suspension of tetrafluoroethylene resin particles while being stirred. The resulting mixture is subjected to a dispersion treatment 6 times in which the pressure is increased to 400 $kgf/cm^2$ ($3.92\times10^{-1}$ Pa) with a high-pressure homogenizer "LA-33S" produced by NANOMIZER Inc. equipped with a through-type chamber in which a narrow channel is formed. Thus, a dispersion of tetrafluoroethylene resin particles is formed. The dispersion is further mixed with 0.2 parts of 2,6-di-t-butyl-4-methylphenol in order to prepare a charge-transporting-layer forming liquid. This coating liquid is applied onto the surface of the charge generating layer, and the resulting coating film is dried at 115° C. for 40 minutes to form a charge transporting layer having a thickness of 22 μm.

A photoreceptor that includes an undercoat layer, a charge generating layer, and a charge transporting layer that are stacked on top of one another in this order is prepared in the above-described manner.

Example 1

Preparation of Charging Roller 1

Preparation of Rubber Composition

A mixture of the following materials is kneaded with a 2.5-liter kneader to form a rubber composition.

Rubber material: 100 parts (epichlorohydrin-ethylene oxide-allyl glycidyl ether copolymer rubber "Hydrin T3106" produced by Zeon Corporation)

Conductant agent "carbon black #3030B" produced by Mitsubishi Chemical Corporation: 5 parts Ion conductant agent (benzyltrimethylammonium chloride, "BTEAC" produced by Lion Specialty Chemicals Co., Ltd.: 1 part Vulcanizing agent (organosulfur, 4,4'-dithiodimorpholine "BALNOC R" produced by OUCHI SHINKO CHEMICAL INDUSTRIAL CO., LTD.): 1.5 parts Vulcanization accelerator A (thiazole vulcanization accelerator, di-2-benzothiazolyl disulfide "NOCCELER DM-P" produced by OUCHI SHINKO CHEMICAL INDUSTRIAL CO., LTD.): 1.5 parts Vulcanization accelerator B (thiuram vulcanization accelerator, tetraethylthiuram disulfide "NOCCELER TET-G" produced by OUCHI SHINKO CHEMICAL INDUSTRIAL CO., LTD.): 1.8 parts Vulcanization assistant (zinc oxide "Zinc Oxide I" product produced by SEIDO CHEMICAL INDUSTRY CO., LTD.): 3 parts Stearic acid: 1.0 parts Heavy calcium carbonate: 40 parts Preparation of Elastic Roll A conductive substrate is prepared by depositing a nickel film having a thickness of 5 μm on the surface of a SUM23L bar having a diameter of 8 mm by electroless nickel plating and treating the resulting SUM23L bar with hexavalent chromic acid.

While the rubber composition is extruded with a single-screw rubber extruder (cylinder inside diameter: 60 mm, L/D: 20, where L and D represent the length and diameter of the screw of the single-screw rubber extruder, respectively) at a screw speed of 25 rpm, the conductive substrate is passed through a crosshead continuously so as to be covered with the rubber composition. The temperature conditions of the extruder are set such that the temperatures of the cylinder part, the screw part, the head part, and the die part are all 80° C. The resulting unvulcanized rubber roll including the conductive substrate and the rubber composition deposited on the conductive substrate is vulcanized in an air-heating furnace at 165° C. for 70 minutes to form an elastic roll having a diameter of 12 mm.

Preparation of Surface Layer

A mixture of the following materials is dispersed with a bead mill to form a surface-layer forming dispersion. The surface-layer forming dispersion is diluted with methanol and subsequently applied onto the surface of the elastic roll by dip coating. The resulting coating film is dried by being heated at 160° C. for 30 minutes. Thus, a surface layer having a thickness of 10 μm is prepared.

A charging roller 1 (i.e., charging member) including a surface layer is prepared in the above-described manner.

- Polymer 1 (N-methoxymethyl nylon "F30K" produced by Nagase ChemteX Corporation): 100 parts
- Polymer 2 (polyvinyl butyral resin "S-LEC BL-1" produced by SEKISUI CHEMICAL CO., LTD.): 10 parts
- Inorganic conductant agent (zinc oxide "Pazet AB" produced by HakusuiTech Co., Ltd.): 20 parts
- Organic conductant agent (alizarin, produced by Tokyo Chemical Industry Co., Ltd.): 1 part
- Filler (polyamide resin "Orgasol2001DNat1" produced by Alkema): 20 parts
- Catalyst "Nacure4167" produced by Kusumoto Chemicals, Ltd.): 4 parts
- Solvent 1 (methanol): 700 parts
- Solvent 2 (butanol): 200 parts

Examples 2 to 21 and Comparative Examples 1 to 10

In Examples 2 to 21 and Comparative Examples 1 to 10, a charging roller is prepared as in the preparation of the charging roller 1 in Example 1, except that the type and content of the inorganic conductant agent and the type and content of the organic conductant agent that are included in the surface-layer forming dispersion are each changed as described in Tables 1 and 2.

Evaluations

The charging rollers prepared in Examples 1 to 21 and Comparative Examples 1 to 10 are each evaluated in terms of image quality, inconsistency in charging property, and migration of conductant agents in the following manner. Tables 1 and 2 summarize the results.

Image Quality Evaluation

The photoreceptor prepared above and each of the charging rollers prepared in Examples 1 to 21 and Comparative Examples 1 to 10 are attached to a drum cartridge included in a color copier "DocuCentre-IV C2260" produced by Fuji Xerox Co., Ltd. The charging device is a contact charging device.

Using the color copier, halftone images having image densities of 50% and 30% and a white-paper image having an image density of 0% are each formed all over the surfaces of 20,000 A3 sheets of paper in a low-temperature, low-humidity environment (10° C. and 15% RH). For each of the halftone images (image density: 50% and 30%) and the white-paper image (image density: 0%), images formed on the first (i.e., initial) and 20,000th sheets are evaluated in accordance with the following criteria.

Since all the images formed on the first sheets are evaluated as "A", Tables 1 and 2 describe only the evaluation results of the images formed on the 20,000th sheets.

Evaluation Criteria

A: Image defects such as inconsistent concentration, white spots, color spots, and streaks are absent.

B: Image defects such as inconsistent concentration, white spots, color spots, and streaks are slightly present partially.

C: Image defects such as inconsistent concentration, white spots, color spots, and streaks are slightly present.

D: Image defects such as inconsistent concentration, white spots, color spots, and streaks are present.

Evaluation of Inconsistency in Charging Property

Inconsistency in the charging property of each of the charging rollers is evaluated by measuring the electrical resistances of the surface of the charging roller prior and subsequent to the image quality evaluation.

Specifically, each of the charging rollers that have not been evaluated in terms of image quality is brought into contact with a roller electrode at the following three points: the points 20 mm from the respective ends and the center of the charging roller in the axis direction. A voltage of 100 V is applied between the conductive substrate of the charging roller and each of the roller electrodes. While the charging roller is rotated one turn, the maximum and minimum amounts of current that flows between the conductive substrate and each of the roller electrodes are measured. The maximum and minimum electrical resistances of the surface of the charging roller are determined from the maximum and minimum amounts of current and the amount of voltage applied. A gap between the maximum electrical resistance and the minimum electrical resistance is calculated from the measured electrical resistances. Hereinafter, this gap is referred to as "initial resistance gap".

Subsequently, the electrical resistance of the surface of each of the charging rollers that have been evaluated in terms of image quality is measured at the above three points by the above-described method, and a gap between the maximum electrical resistance and the minimum electrical resistance is calculated. Hereinafter, this gap is referred to as "post-printing resistance gap". Inconsistency in the charging property of each of the charging rollers is evaluated on the basis of a difference between the initial resistance gap and the post-printing resistance gap with reference to the following criteria.

Evaluation Criteria

A: |Initial Resistance Gap−Post-Printing Resistance Gap|$\leq 1\times10^{0.3}\Omega$ B: $1\times10^{0.3}\Omega<$|Initial Resistance Gap−Post-Printing Resistance Gap|$\leq 1\times10^{0.5}\Omega$ C: $1\times10^{0.5}\Omega<$|Initial Resistance Gap−Post-Printing Resistance Gap|

Evaluation of Migration of Conductant Agent

Migration of the inorganic conductant agent is evaluated by observing the conductant agent included in the surface layer of each of the charging rollers with a scanning electron microscope (SEM) "S-4700" produced by Hitachi, Ltd. prior and subsequent to the image quality evaluation. In this evaluation, only the inorganic conductant agent is observed because the inorganic conductant agent is more likely to be migrate with time than the organic conductant agent.

Specifically, the position of the inorganic conductant agent in the surface layer is observed at the following three points: the points 20 mm from the respective ends and the center of the charging roller in the axis direction.

At each of the above points, the position of the inorganic conductant agent prior to the image quality evaluation and the position of the inorganic conductant agent subsequent to the image quality evaluation are compared with each other. The point at which the distance of the migration of the inorganic conductant agent is maximum is evaluated in accordance with the following criteria.

Evaluation Criteria

A: The distance of migration of the inorganic conductant agent is 0.5 μm or less.

B: The distance of migration of the inorganic conductant agent is more than 0.5 μm and 1 μm or less.

C: The distance of migration of the inorganic conductant agent is more than 1 μm and 2 μm or less.

D: The distance of migration of the inorganic conductant agent is more than 2 μm.

TABLE 1

| | Surface-layer forming liquid | | | | | | Surface layer Inorganic conductant agent/organic conductant agent [molar ratio] | Evaluation of inconsistency in charging property [Initial-Post-printing] [Ω] | Image Quality Evaluation After printing of 20,000 sheets (image density) | | | | Evaluation of migration of conductant agent |
|---|---|---|---|---|---|---|---|---|---|---|---|---|---|
| | Filler | Inorganic conductant agent | | Organic conductant agent | | | | | | | | | |
| | Part | Type | Part | Type | Molecular weight | Part | | | Result | 50% | 30% | 0% | |
| Example 1 | 20 | ZnO | 20 | Alizarin | 240 | 1 | 59/1 | $1 \times 10^{0.24}$ | A | A | A | A | A |
| Example 2 | 20 | ZnO | 20 | Anthraquinone | 208 | 1 | 51/1 | $1 \times 10^{0.36}$ | B | A | A | A | A |
| Example 3 | 20 | ZnO | 20 | Quinizarin | 240 | 1 | 59/1 | $1 \times 10^{0.27}$ | A | B | B | B | A |
| Example 4 | 20 | ZnO | 20 | Quinalizarin | 272 | 1 | 67/1 | $1 \times 10^{0.4}$ | B | B | B | B | B |
| Example 5 | 20 | $SnO_2$ | 20 | Alizarin | 240 | 1 | 32/1 | $1 \times 10^{0.3}$ | A | A | A | A | A |
| Example 6 | 20 | $SnO_2$ | 20 | Anthraquinone | 208 | 1 | 28/1 | $1 \times 10^{0.35}$ | B | B | B | B | B |
| Example 7 | 20 | $SnO_2$ | 20 | Quinizarin | 240 | 1 | 67/1 | $1 \times 10^{0.22}$ | A | A | A | A | A |
| Example 8 | 20 | $SnO_2$ | 20 | Quinalizarin | 272 | 1 | 67/1 | $1 \times 10^{0.23}$ | A | A | A | A | A |
| Example 9 | 20 | $TiO_2$ | 20 | Alizarin | 240 | 1 | 67/1 | $1 \times 10^{0.22}$ | A | A | A | A | A |
| Example 10 | 20 | $TiO_2$ | 20 | Anthraquinone | 208 | 1 | 67/1 | $1 \times 10^{0.35}$ | B | B | B | B | A |
| Example 11 | 20 | $TiO_2$ | 20 | Quinizarin | 240 | 1 | 67/1 | $1 \times 10^{0.19}$ | A | A | A | A | A |
| Example 12 | 20 | $TiO_2$ | 20 | Quinalizarin | 272 | 1 | 67/1 | $1 \times 10^{0.33}$ | B | B | B | B | B |
| Example 13 | 20 | Zn | 20 | Alizarin | 240 | 1 | 67/1 | $1 \times 10^{0.38}$ | B | B | B | B | B |
| Example 14 | 20 | Zn | 20 | Anthraquinone | 208 | 1 | 67/1 | $1 \times 10^{0.4}$ | B | B | B | B | B |
| Example 15 | 20 | Zn | 20 | Quinizarin | 240 | 1 | 67/1 | $1 \times 10^{0.38}$ | B | B | B | B | B |
| Example 16 | 20 | Zn | 20 | Quinalizarin | 272 | 1 | 67/1 | $1 \times 10^{0.37}$ | B | B | B | B | B |
| Example 17 | 20 | ZnO | 20 | o-Benzoquinone | 108 | 1 | 67/1 | $1 \times 10^{0.34}$ | B | B | B | B | A |
| Example 18 | 0 | ZnO | 20 | Alizarin | 240 | 1 | 67/1 | $1 \times 10^{0.38}$ | B | B | B | B | B |
| Example 19 | 0 | ZnO | 20 | Anthraquinone | 208 | 1 | 67/1 | $1 \times 10^{0.42}$ | B | B | B | B | A |
| Example 20 | 0 | ZnO | 20 | Quinizarin | 240 | 1 | 67/1 | $1 \times 10^{0.40}$ | B | B | B | B | A |
| Example 21 | 0 | ZnO | 20 | Quinalizarin | 272 | 1 | 67/1 | $1 \times 10^{0.42}$ | B | B | B | B | B |

TABLE 2

| | Surface-layer forming liquid | | | | | | Surface layer Inorganic conductant agent/organic conductant agent [molar ratio] | Evaluation of inconsistency in charging property [Initial-Post-printing] [Ω] | Image Quality Evaluation After printing of 20,000 sheets (image density) | | | | Evaluation of migration of conductant agent |
|---|---|---|---|---|---|---|---|---|---|---|---|---|---|
| | Filler | Inorganic conductant agent | | Organic conductant agent | | | | | | | | | |
| | Part | Type | Part | Type | Molecular weight | Part | | | Result | 50% | 30% | 0% | |
| Comparative example 1 | 20 | CB | 20 | Alizarin | 240 | 1 | 400/1 | $1 \times 10^{0.72}$ | C | D | D | D | C |
| Comparative example 2 | 20 | CB | 20 | Anthraquinone | 208 | 1 | 347/1 | $1 \times 10^{0.68}$ | C | D | D | D | D |
| Comparative example 3 | 20 | CB | 20 | Ouinizarin | 240 | 1 | 400/1 | $1 \times 10^{0.63}$ | C | D | D | D | D |
| Comparative example 4 | 20 | CB | 20 | Quinalizarin | 272 | 1 | 453/1 | $1 \times 10^{0.56}$ | C | D | D | D | C |
| Comparative example 5 | 20 | ZnO | 20 | Anthracene | 178 | 1 | 44/1 | $1 \times 10^{0.57}$ | C | C | C | C | C |
| Comparative example 6 | 20 | $SnO_2$ | 20 | Anthracene | 178 | 1 | 24/1 | $1 \times 10^{0.66}$ | C | D | D | D | D |
| Comparative example 7 | 20 | $TiO_2$ | 20 | Anthracene | 178 | 1 | 45/1 | $1 \times 10^{0.58}$ | C | C | C | C | C |

TABLE 2-continued

| | Surface-layer forming liquid | | | | | | Surface layer Inorganic conductant agent/organic conductant agent [molar ratio] | Evaluation of inconsistency in charging property \|Initial-Post-printing\| | | Image Quality Evaluation After printing of 20,000 sheets (image density) | | | Evaluation of migration of conductant agent |
|---|---|---|---|---|---|---|---|---|---|---|---|---|---|
| | Filler | Inorganic conductant agent | | Organic conductant agent | | | | | | | | | |
| | Part | Type | Part | Type | Molecular weight | Part | | [Ω] | Result | 50% | 30% | 0% | |
| Comparative example 8 | 20 | ZnO | 20 | Phthalocyanine | 514 | 1 | 126/1 | $1 \times 10^{0.73}$ | C | D | D | D | D |
| Comparative example 9 | 20 | $SnO_2$ | 20 | Phthalocyanine | 514 | 1 | 68/1 | $1 \times 10^{0.6}$ | C | D | D | D | C |
| Comparative example 10 | 20 | $TiO_2$ | 20 | Phthalocyanine | 514 | 1 | 129/1 | $1 \times 10^{0.66}$ | C | C | C | C | C |

Notes for Tables 1 and 2

The term "Inorganic conductant agent/organic conductant agent [molar ratio]" refers to the ratio of the number of moles of the inorganic conductant agent included in the surface layer to the number of moles of the organic conductant agent included in the surface layer.

The abbreviation "CB" stands for "carbon black".

The term "|Initial−Post printing| in "Evaluation of inconsistency in charging property" refers to the absolute value of the difference between the initial resistance gap and the post-printing resistance gap.

The results described in Tables 1 and 2 confirm that an increase in inconsistency in the charging property of each of the charging rollers prepared in Examples with time is limited compared with the charging rollers prepared in Comparative Examples.

It is also confirmed that the migration of the inorganic conductant agent in the surface layer of each of the charging rollers prepared in Examples which occurs with time is limited compared with the charging rollers prepared in Comparative Examples.

It is further confirmed that, in images formed with an image forming apparatus including any one of the charging rollers prepared in Examples, occurrence of image defects is reduced even in a low-temperature, low-humidity environment (10° C. and 15% RH).

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. This exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member comprising:

a conductive substrate; and a surface layer on the conductive substrate, the surface layer including an inorganic conductant agent including a metal and an organic conductant agent including a coordinating atom capable of coordinating to the metal, the organic conductant agent having a molecular weight of 400 or less, wherein the organic conductant agent includes at least one selected from particles of anthraquinone and particles of an anthraquinone derivative, and a molar ratio of the inorganic conductant agent to the organic conductant agent is from 20:1 to 100:1.

2. The charging member according to claim 1, wherein the inorganic conductant agent includes particles of a metal oxide.

3. The charging member according to claim 1, wherein the particles of anthraquinone derivative are particles of a compound represented by General Formula (1), (1)

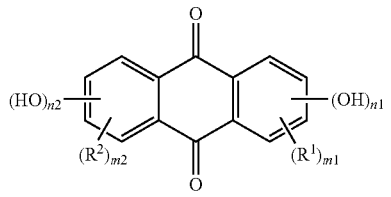

where n1 and n2 each independently represent an integer of from 0 to 3 and do not become 0 simultaneously; m1 and m2 each independently represent an integer of 0 or 1; and $R^1$ and $R^2$ each independently represent an alkyl group having from 1 to 10 carbon atoms, an alkoxy group having from 1 to 10 carbon atoms, or a carboxy group.

4. The charging member according to claim 1, wherein the anthraquinone and the anthraquinone derivative are at least one compound selected from anthraquinone, alizarin, quinizarin, and quinalizarin.

5. The charging member according to claim 1, wherein the surface layer further includes a filler.

6. The charging member according to claim 1, wherein the molar ratio of the inorganic conductant agent to the organic conductant agent is from 27:1 to 83:1.

7. A process cartridge detachably attachable to an image forming apparatus, the process cartridge comprising:

an image carrier; and a charging unit including the charging member according to claim 1, the charging unit charging a surface of the image carrier by bringing the charging member into contact with the surface of the image carrier.

8. An image forming apparatus comprising:

an image carrier;

a charging unit including the charging member according to claim 1, the charging unit charging a surface of the image carrier by bringing the charging member into contact with the surface of the image carrier;

a latent-image forming unit that forms a latent image on the charged surface of the image carrier;

a developing unit that develops the latent image formed on the surface of the image carrier with a toner in order to form a toner image; and a transfer unit that transfers the toner image formed on the surface of the image carrier to a recording medium.

9. The charging member according to claim 1, wherein the organic conduct agent is selected from the group consisting of:

Formula 1-2

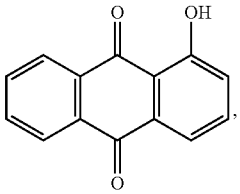

Formula 1-3

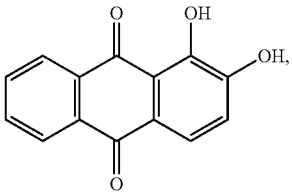

Formula 1-4

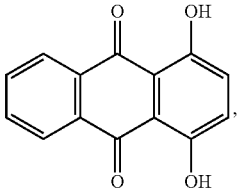

Formula 1-5

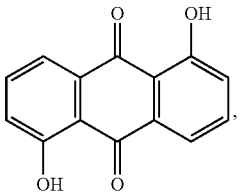

Formula 1-6

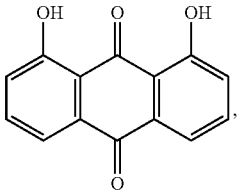

Formula 1-7

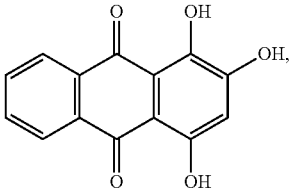

-continued

Formula 1-8

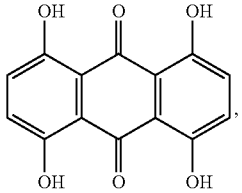

Formula 1-9

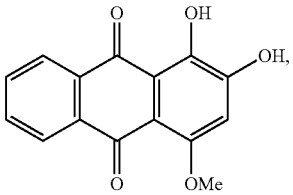

Formula 1-10

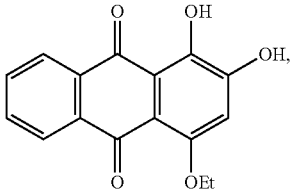

Formula 1-11

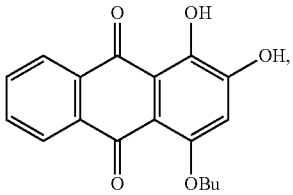

Formula 1-12

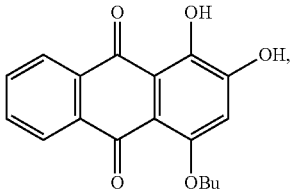

Formula 1-13

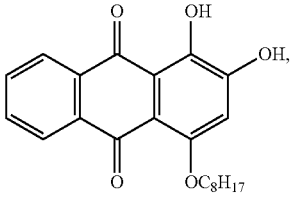

and

Formula 1-14

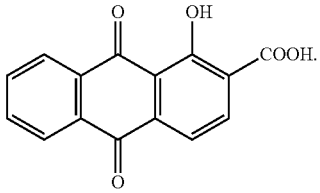

10. The charging member according to claim 1, wherein the inorganic conductant agent is selected from the group consisting of ZnO, $SnO_2$ and $TiO_2$.

11. The charging member according to claim 1, wherein the inorganic conductant agent is selected from the group consisting of $SnCl_2$, $CuCl_2$ and $NiCl_2$.

12. The charging member according to claim 1, wherein the average particle diameter of the inorganic conductant agent is from 25 to 200 nm.

13. The charging member according to claim 1, wherein the average particle diameter of the inorganic conductant agent is from 50 to 100 nm.

14. The charging member according to claim 1, wherein the average particle diameter of the organic conductant agent is from 50 nm or less.

* * * * *